US009116499B1

(12) United States Patent
Harrington

(10) Patent No.: US 9,116,499 B1
(45) Date of Patent: Aug. 25, 2015

(54) ENHANCED TONER THROUGHPUT AGITATOR CONFIGURATION FOR A CUSTOMER REPLACEABLE UNIT

(71) Applicant: XEROX CORPORATION, Norwalk, CT (US)

(72) Inventor: John Patrick Harrington, Meredith, NH (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/305,014

(22) Filed: Jun. 16, 2014

(51) Int. Cl.
*G03G 21/00* (2006.01)
*G03G 21/10* (2006.01)

(52) U.S. Cl.
CPC ..... *G03G 21/105* (2013.01); *G03G 21/0011* (2013.01)

(58) Field of Classification Search
CPC ..... G03G 21/105; G03G 21/10; G03G 21/12
USPC ..... 399/358, 359, 360
See application file for complete search history.

(56) References Cited

U.S. PATENT DOCUMENTS

| | | | | |
|---|---|---|---|---|
| 5,778,296 | A | 7/1998 | van der Steen et al. | |
| 6,085,062 | A * | 7/2000 | Mizuishi et al. | 399/358 |
| 7,099,617 | B2 * | 8/2006 | Jeong et al. | 399/358 |
| 7,437,116 | B2 * | 10/2008 | Lee | 399/359 |
| 7,627,274 | B2 * | 12/2009 | Ishiguro et al. | 399/258 |
| 8,000,644 | B2 * | 8/2011 | Hoshino | 399/358 |
| 2008/0267661 | A1 * | 10/2008 | Yoshida et al. | 399/120 |
| 2010/0150613 | A1 * | 6/2010 | Furuta et al. | 399/258 |
| 2010/0172674 | A1 * | 7/2010 | Suzuki | 399/258 |
| 2012/0294654 | A1 * | 11/2012 | Ninomiya | 399/254 |

* cited by examiner

*Primary Examiner* — Clayton E LaBalle
*Assistant Examiner* — Trevor J Bervik

(57) ABSTRACT

A customer replaceable unit for a printer includes a toner reclaim system that has a spring-like wire attached to and surrounding the bottom half of a toner agitator. As the agitator is rotated by a cleaner auger through a crankshaft connection, the spring compresses and relaxes with every revolution. This creates small vibrations which help move toner in a downward direction with the assistance of gravity into a developer sump.

20 Claims, 14 Drawing Sheets

ENHANCED TONER THROUGHPUT AGITATOR CONFIGURATION FOR A CUSTOMER REPLACEABLE UNIT

The present disclosure relates to a customer replaceable unit (CRU) for an electrostatographic printer or the like, and more particularly, to an agitator configuration for improving toner throughput in a customer replaceable unit for use in such printers.

In a typical electrostatographic printing process, a photoconductive member is charged to a substantially uniform potential so as to sensitize the surface thereof. The charged portion of the photoconductive member is exposed to a light image of an original document placed manually on a platen of the machine or automatically fed onto such platen by a document handler of a machine. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member in a timed manner to a copy sheet fed from a sheet supply. The toner powder image on the copy sheet is subsequently heated to permanently affix it to the copy sheet.

In electrostatographic printing machines using the process described above, a customer replaceable unit is sometimes employed which can be replaced by a customer at the end of life or at the premature failure of one or more of the xerographic components, is shown in prior art FIG. 1. Structures within CRU 10 includes a photoconductive member 12, a bias charge roll 14, exposure at a toner reclaim system 20 that includes a cleaning blade 22 and a cleaner auger 24 enclosed within housing 30. Structures positioned outside the CRU in FIG. 1 includes a development member 40 that is positioned to apply developer to photoconductive member 12, an exposure device 15, an erase lamp 26 for erasing any residual image off the photoreceptor and a bias transfer roll 50 that transfers a developed image to a substrate 28. This CRU is an improvement over known CRUs, as for example, the CRU shown in U.S. Pat. No. 5,778,296 because it includes a toner reclaim system while the CRU in U.S. Pat. No. 5,778,296 stores toner cleaned off a photoreceptor within the interior of the photoreceptor and consequently used only once.

The toner reclaim system of CRU 10 employs auger 24 to move toner across the top of the CRU through the use of a crankshaft 25 in FIG. 2 and into a housing 60 that includes agitator 66. Agitator 66 is connected to auger 24 though crankshaft 25 and is used to assist the passage of toner into a toner sump (not shown) located below an exit of housing 60 where the reclaimed toner is mixed with fresh toner and used to develop new images. As shown in FIG. 3A, reclaimed toner enters the upper end of housing 60 and is pushed onto agitator 66 through initial rotation of crankshaft 25 in a clockwise direction. As the auger 24 through crankshaft 25 moves in FIG. 3B so does the agitator. Crankshaft 25 is configured to move agitator 66 down and up to an original position during each rotation of the crankshaft. The agitator's job is to push toner from the reclaim to the toner sump at a controlled rate. In this agitator configuration fins 67 of blade 66 mostly stay in contact with a lower wall 62 of housing 60 and restrict toner flow. That is, as auger 24 turns as shown in FIGS. 3B and 3C, a majority of fins 67 attached to blade 66 remain in contact with lower wall 62, thus, preventing toner from falling through to the sump. Continued rotation of crankshaft 25 as indicated by the position of arrow 69 in FIG. 3D causes fins 67 on an upper portion of blade 66 to lift off lower wall 62 of housing, but toner is still blocked during agitator rotation by the fins on a lower portion of the blade. With the crankshaft rotated into the position of arrow 69 in FIG. 3E all fins of blade 66 are back down onto lower wall 62 and toner is still blocked and upper wall 61 is not being scrapped by the fins. With crankshaft 25 having been rotated into the position shown by arrow 69 in FIG. 3F agitator 66 has been returned to its starting position for repeating the cycle. A problem arises with use of this toner reclaim system because the toner is not being moved efficiently thorough agitator 61 in housing 60 and clogs up. This results in high torques induced on the system and has led to failures.

Therefore, there is a need for a CRU with an improved toner reclaim system that will move toner through the reclaim system in a more efficient manner.

BRIEF SUMMARY

In answer to this need, provided hereinafter is a method and apparatus for improving toner throughput in a xerographic reclaim system by attaching a spring-like wire to the bottom half of an agitator. As the agitator is rotated by a cleaner auger through a crankshaft connection, the spring compresses and relaxes with every revolution. This creates small mechanical vibrations which help move toner in a downward direction with the assistance of gravity into a developer sump. An alternative agitator improvement is provided that includes a more flexible spine, longer fingers, a modified tail fin and weep holes on a horizontal surface in order to reach more of an exit chute and allow loosened toner to exit more easily.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Referring now to FIG. 4, an improved agitator 100, in accordance with the present disclosure, is shown that is adapted to be moved by crankshaft 25 such that spring 120 which is mounted on a portion of blade 110 is consistently compressed and uncompressed due to constraints at the lower stroke. This motion generated by spring 120 moves toner down to the toner sump. The spring is secured below fins 112 by two parallel plates 114 that sandwich the first rung on an upper end of the spring below fins 112 and by a stop member positioned on an exit portion of housing 60 at the remote end of blade 110. Another improvement of agitator 100 is the extension of fins 112 in order to reach deep spots of housing 60 and scrape toner from upper wall 61 of housing 60 during the toner reclaim process.

Figure 1:
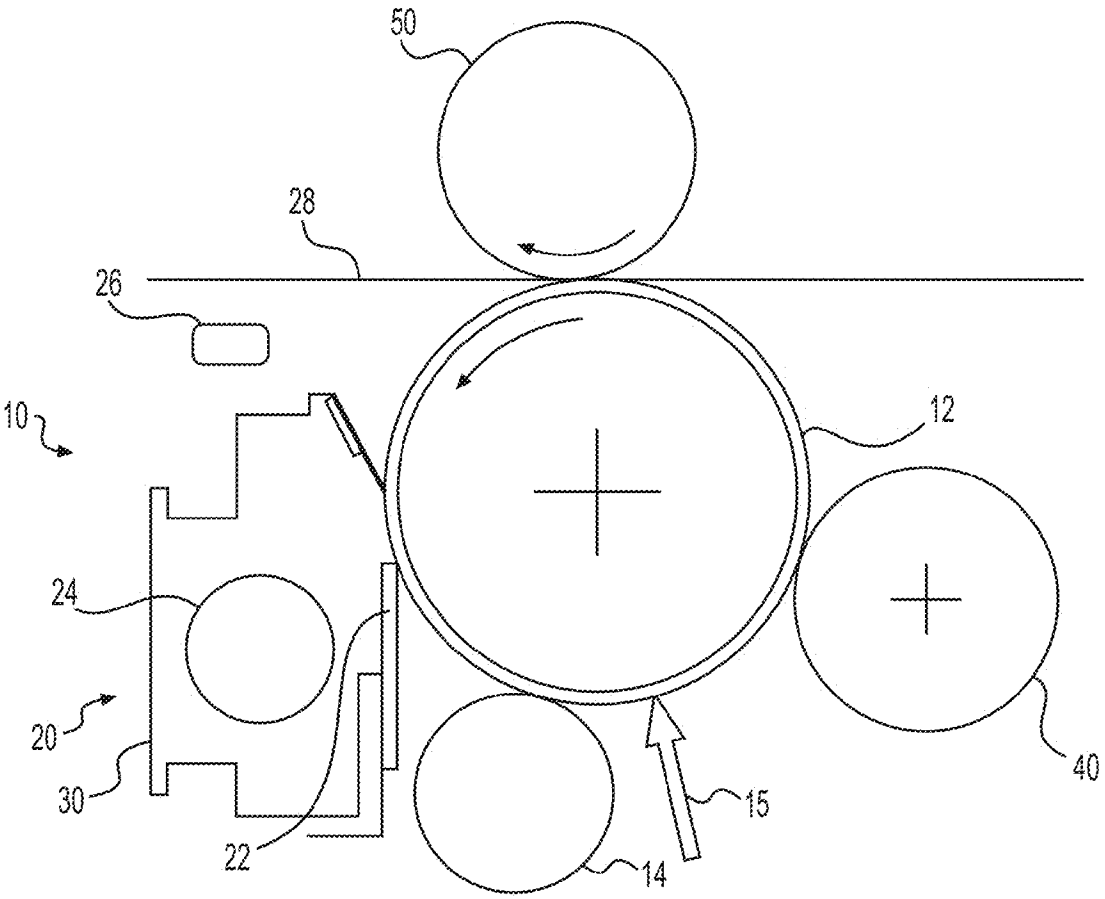
FIG. 1 PRIOR ART
FIG. 1 is a partial, frontal view of a prior art CRU positioned within in a xerographic printer.
Figure 2:
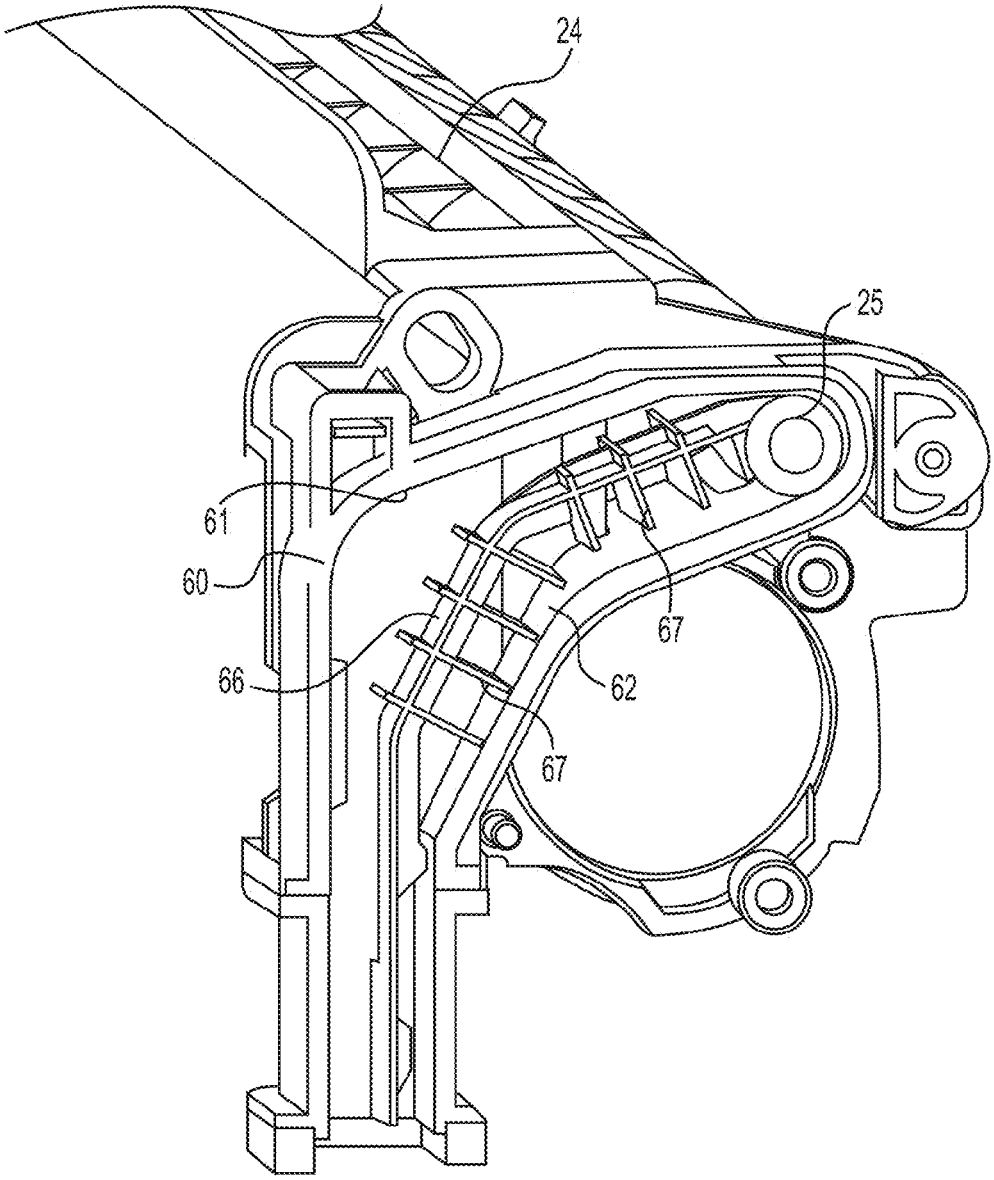
FIG. 2 PRIOR ART
FIG. 2 is a partial, perspective view of the prior art CRU of FIG. 1 showing a crankshaft connected to an agitator.
Figure 3A:
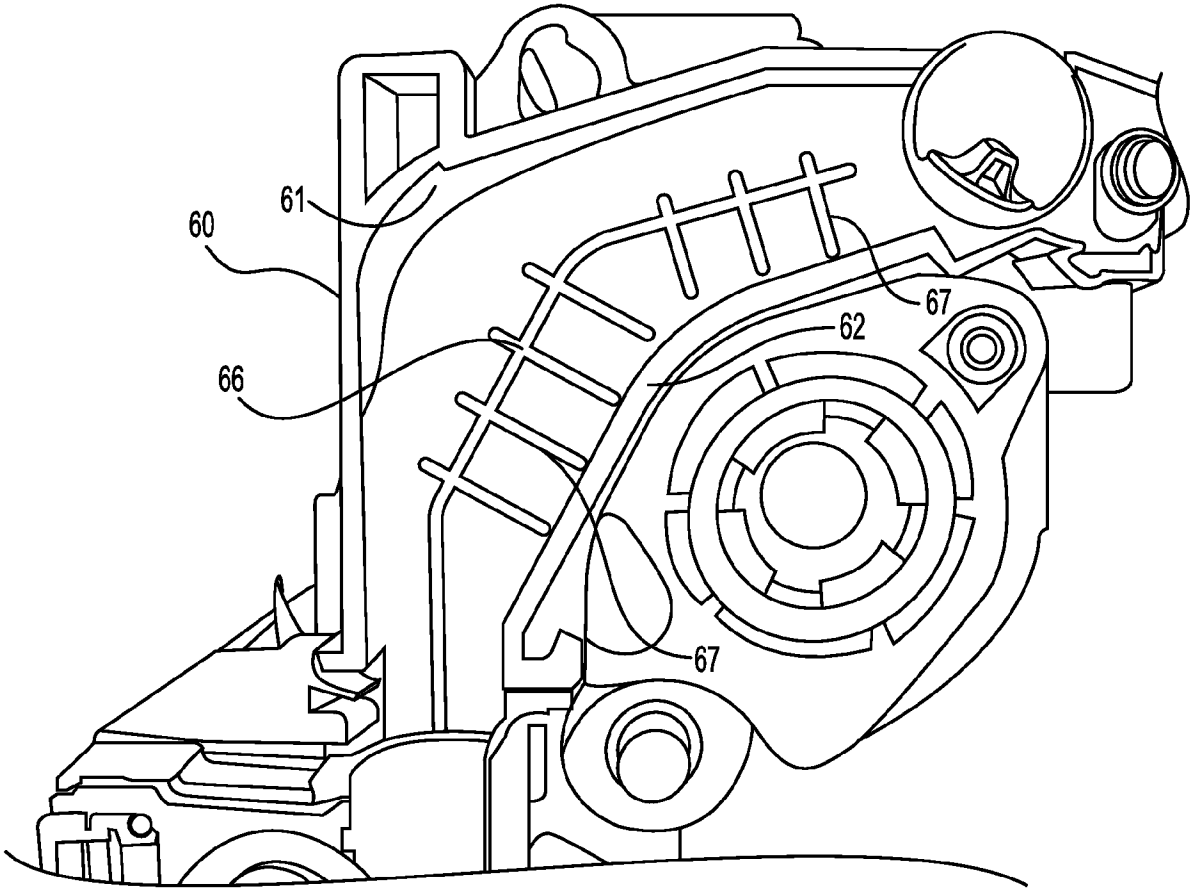
FIG. 3A PRIOR ART
FIGS. 3A-3F are partial, end views of the prior art CRU of FIG. 1 showing how the prior art agitator functions during toner reclaim operations.
Figure 3B:
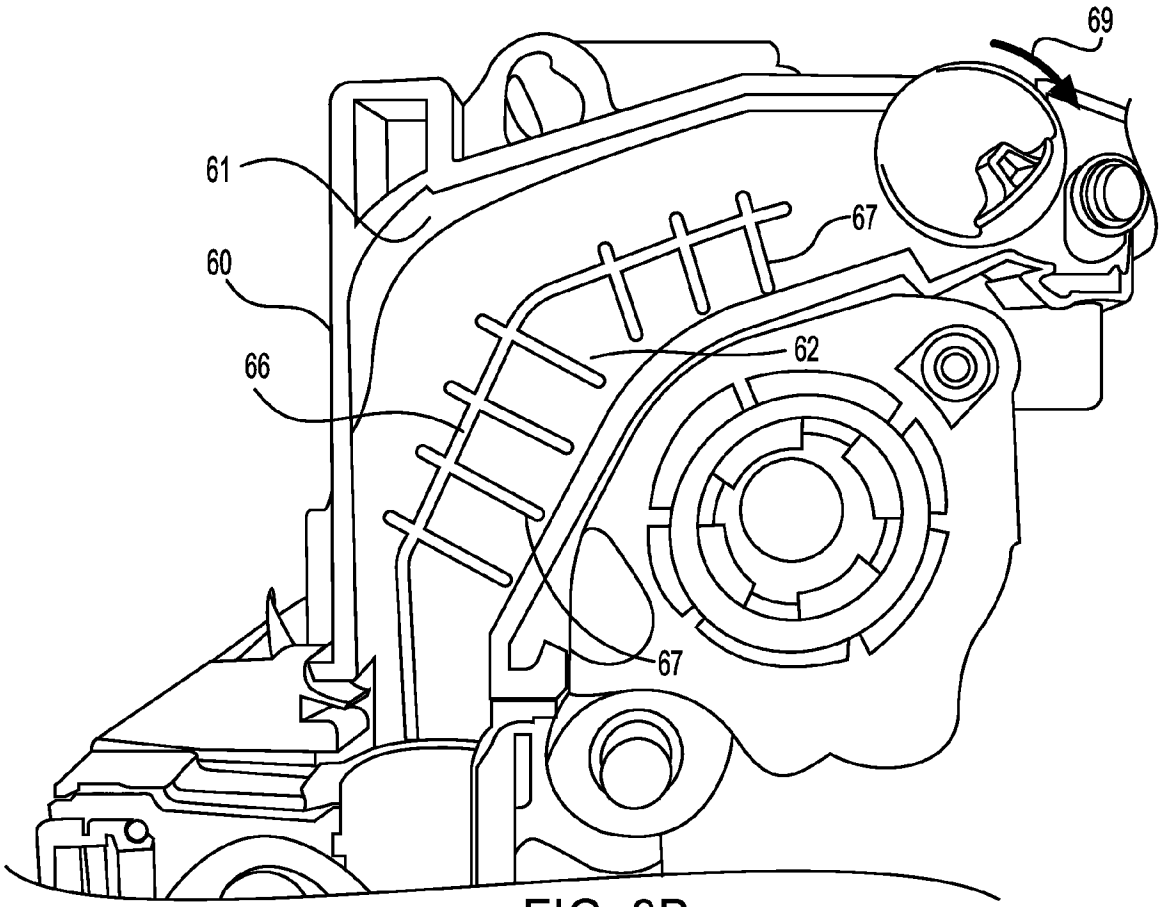
FIG. 3B PRIOR ART
Figure 3C:
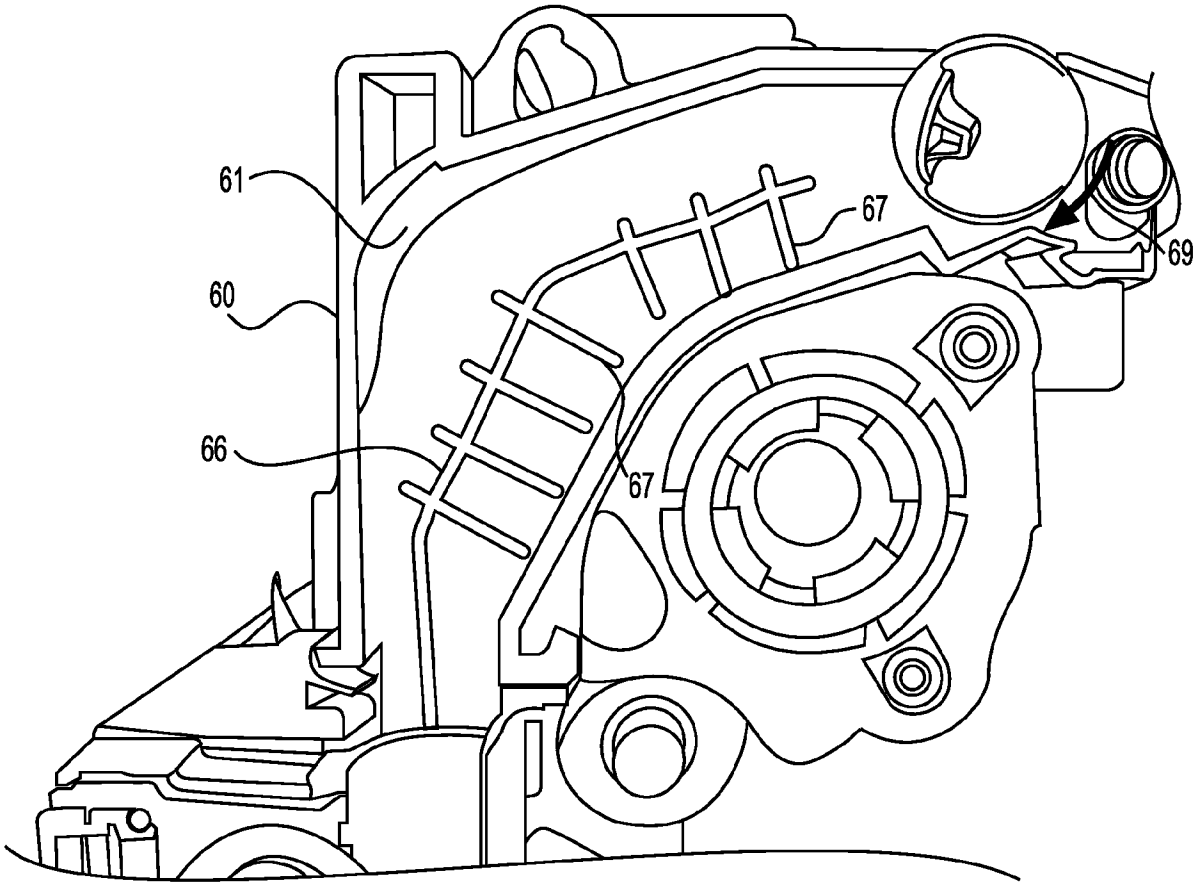
FIG. 3C PRIOR ART
Figure 3D:
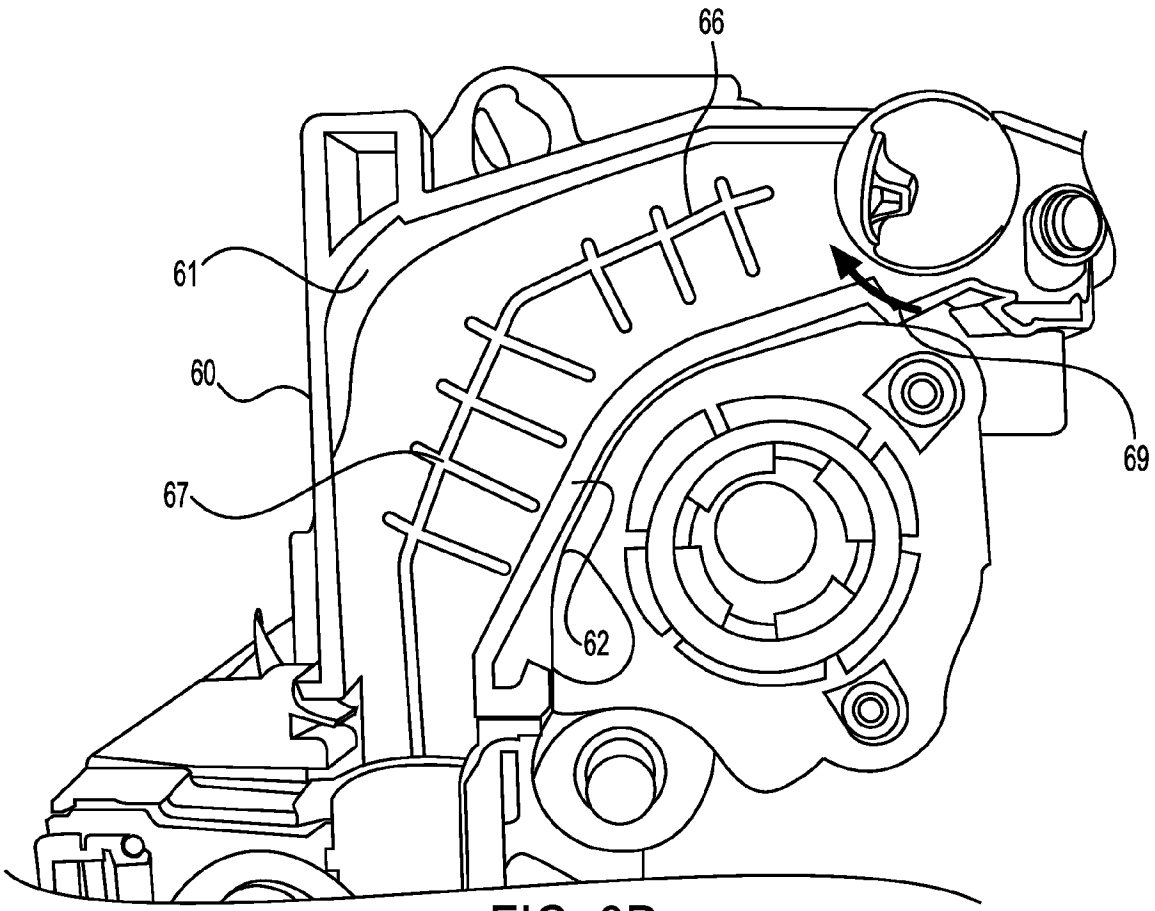
FIG. 3D PRIOR ART
Figure 3E:
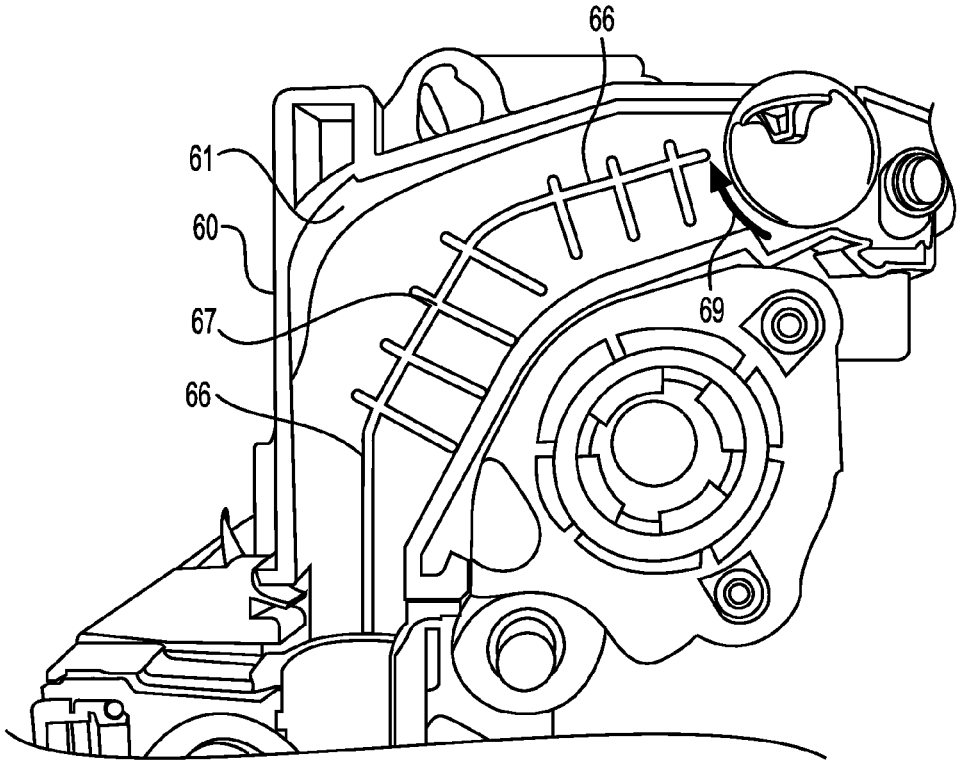
FIG. 3E PRIOR ART
Figure 3F:
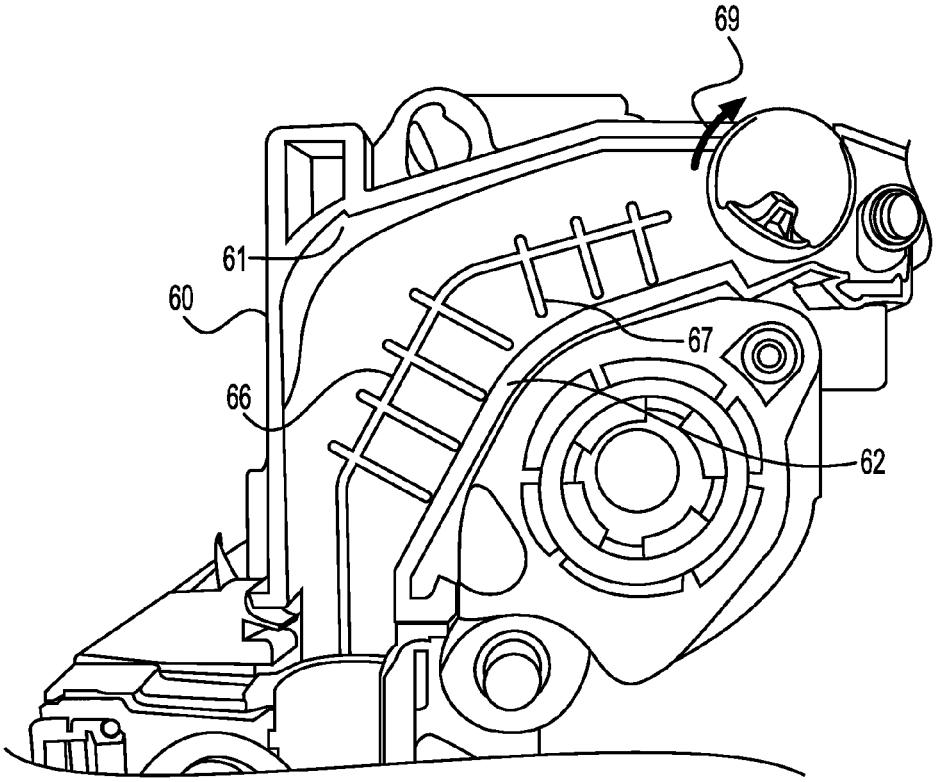
FIG. 3F PRIOR ART
Figure 4:
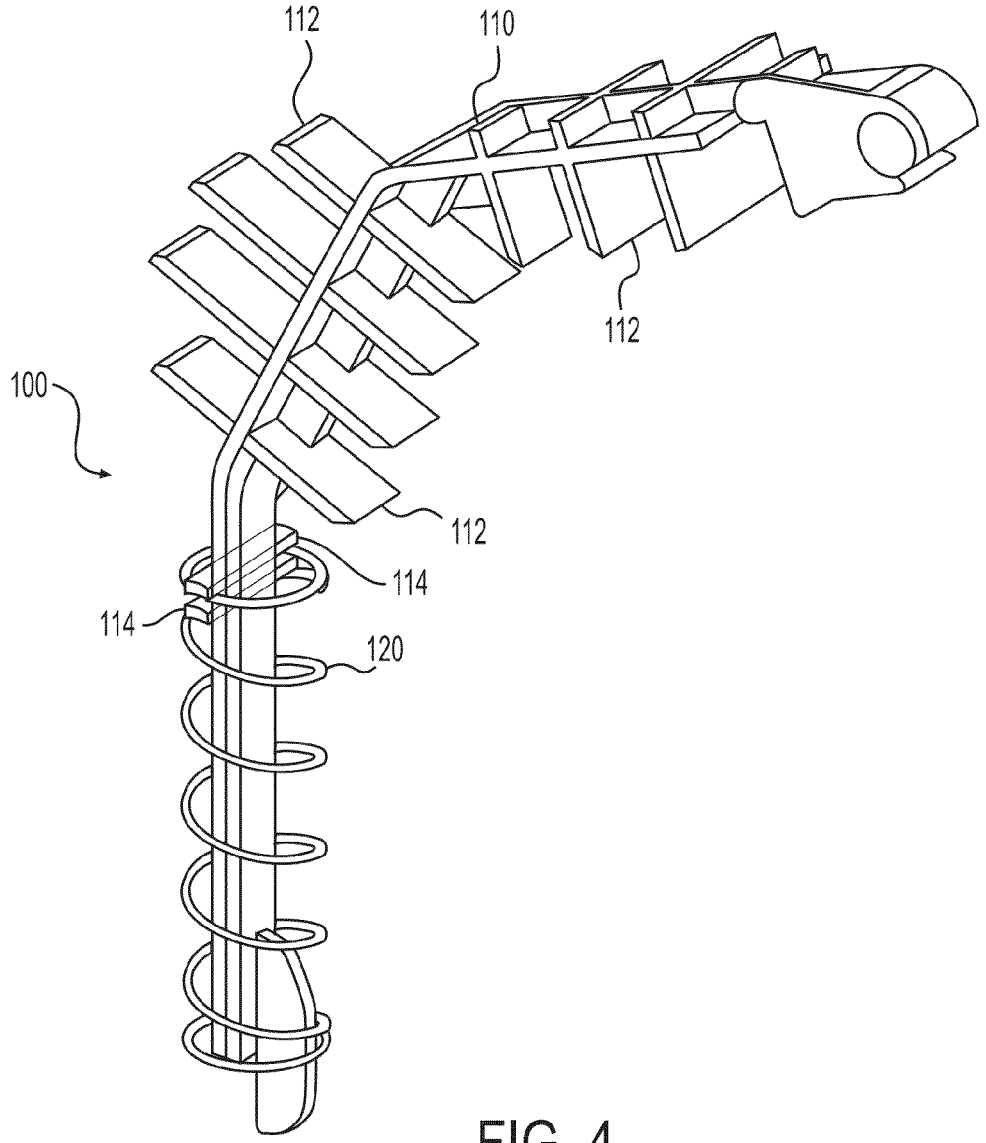
FIG. 4 is a perspective view of an improved agitator in accordance with the present disclosure that includes a spring as a part thereof.
Figure 5A:
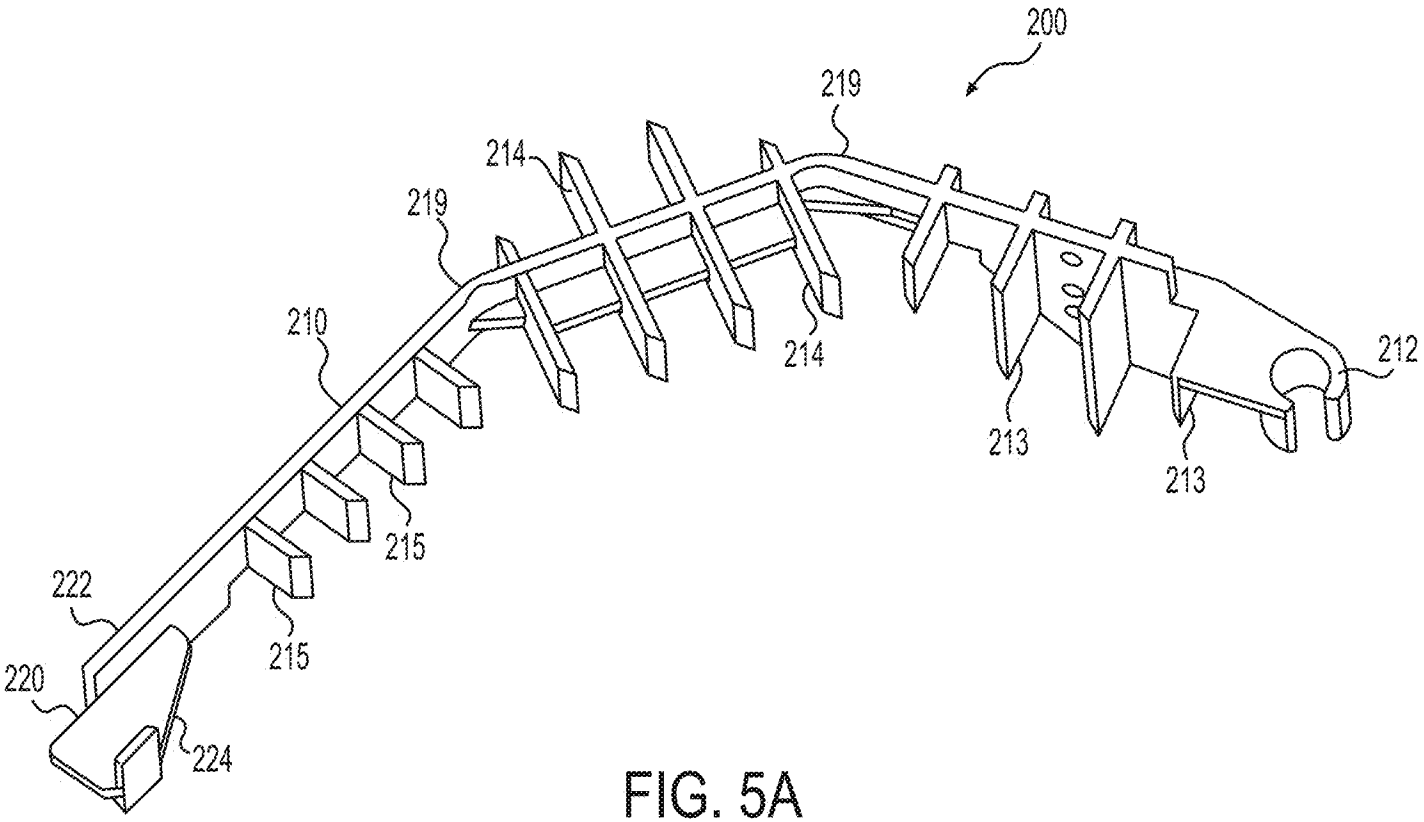
FIG. 5A is a perspective view of an alternative agitator embodiment accordance with the present disclosure.
Figure 5B:
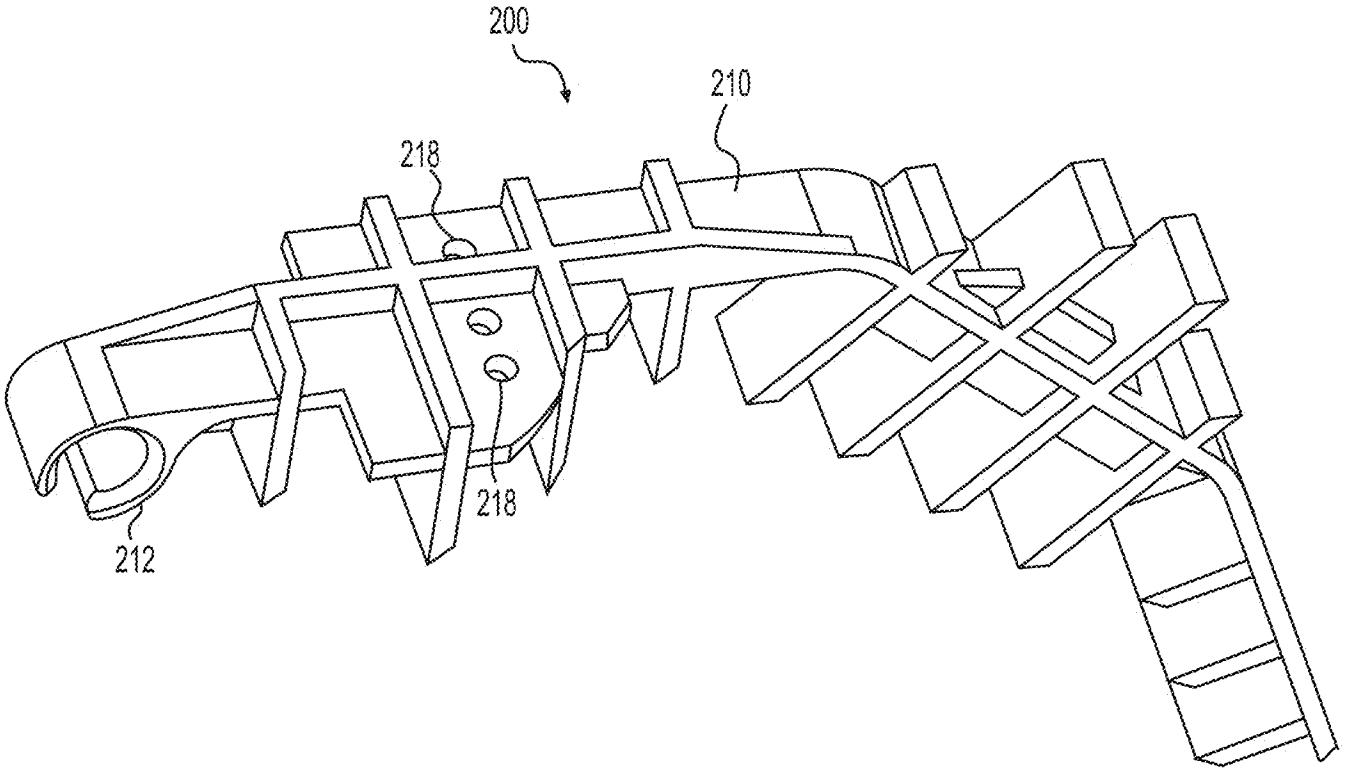
FIG. 5B is a perspective view of the alternative agitator of FIG. 5A showing weep holes in a horizontal portion thereof.

An alternative agitator embodiment of the present disclosure is shown in FIGS. 5A and 5B. In FIG. 5A, agitator 200 includes a blade 210 that has a clip 212 that is attachable to crankshaft 25. Blade 210 includes three sets of fins thereon with the first set of fins 213 being located closest to clip 212, a second set of fins 214 positioned below fins 213 and the third set of fins 215 positioned below the second set of fins 213. Section joints 219 connecting fins 213 and 215 to fins 214 are thinner than other supporting structure of blade 210 in order to enhance flexibility in the agitator. This allows agitator 200 to more easily confirm to upper wall 61 and lower wall 62 to ensure that toner passes through housing 60 and into a toner sump without compaction of toner occurring. Fins 214 and 215 have beveled tips to allow toner to be scrapped from surfaces of upper wall 61 and lower wall 62 of housing 60. Openings 218 shown in FIG. 5B are cut into blade 210 in the area of fins 213 in order to prevent the issue of toner clumping in the area. The tail fin 220 in FIG. 5A is configured to push toner more effectively and create a higher bending torque on the agitator during the down stroke due to wall constraints so the agitator conforms to upper and lower surfaces 61 and 62 of housing 60. A flat backside 222 on tail fin 220 improves clearances between the tail fin and toner exit chute (not shown). A portion 224 of tail fin 220 is slanted to ease up and down movement of the tail fin along a surface of housing 60 during each toner reclaim cycle.

Figure 6B:
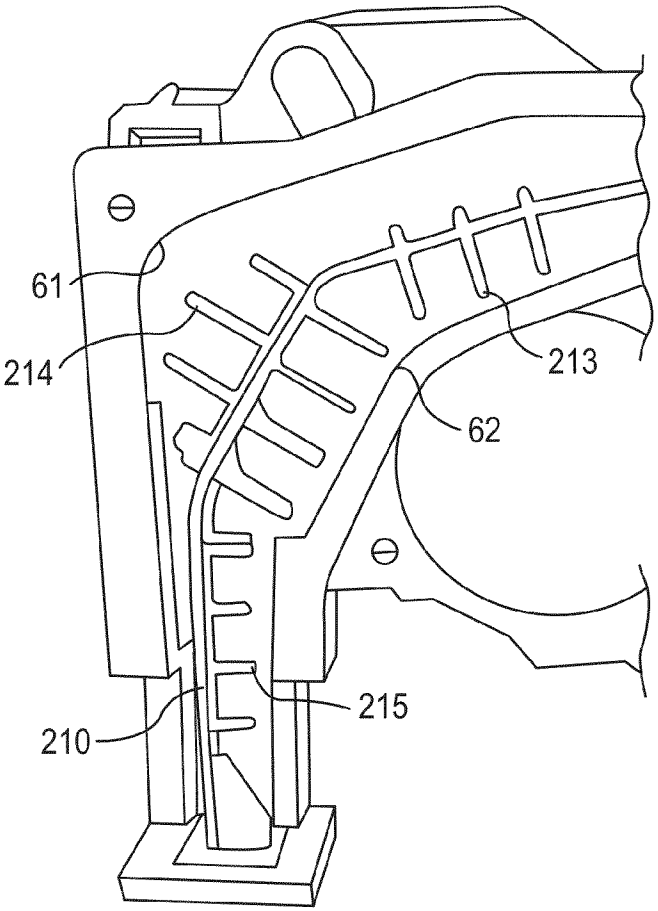
FIGS. 6A-6F are partial, end views of the CRU of FIG. 5A showing how the agitator functions during toner reclaim operations.
Figure 6A:
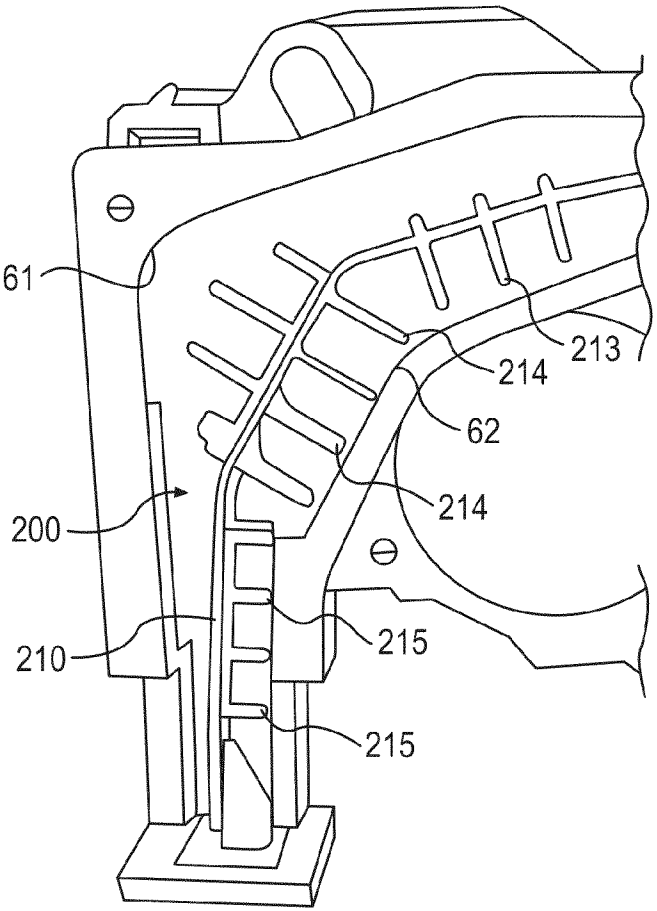
Figure 6D:
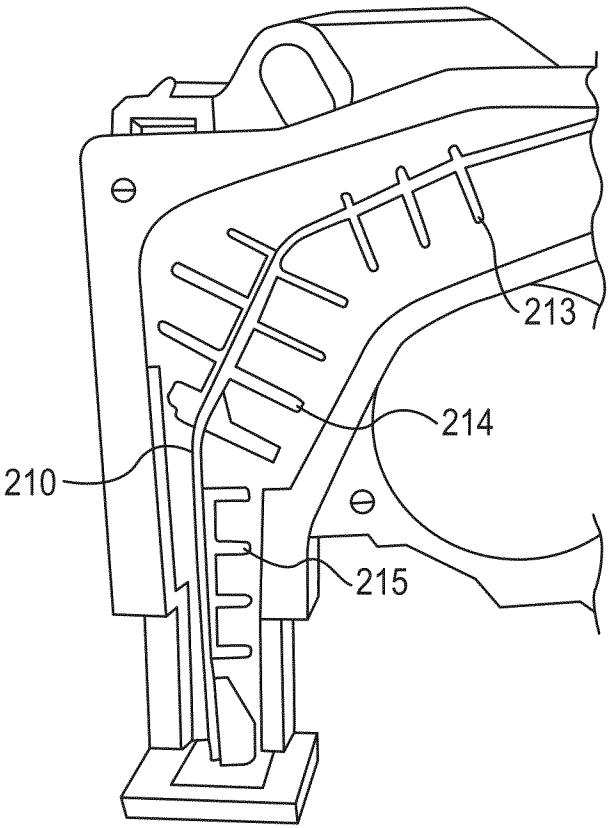
Figure 6C:
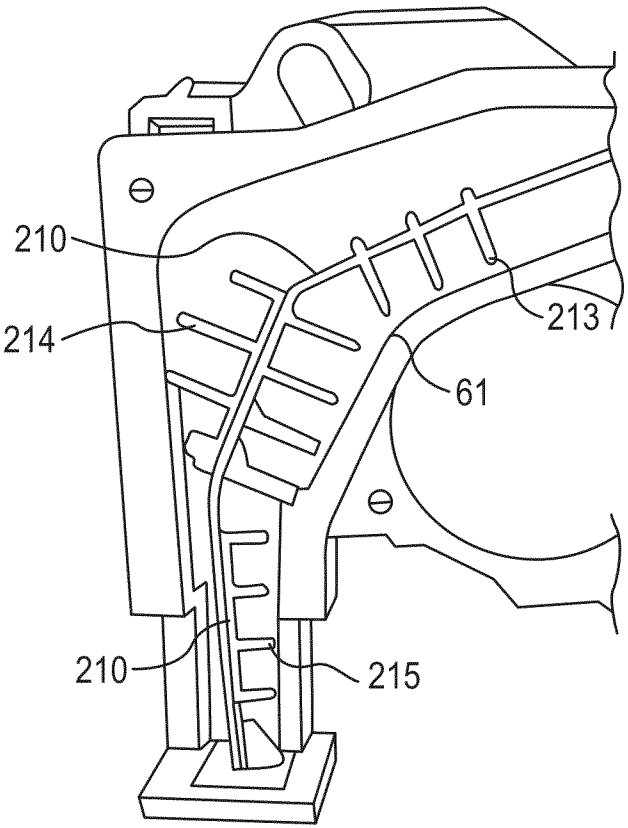
Figure 6F:
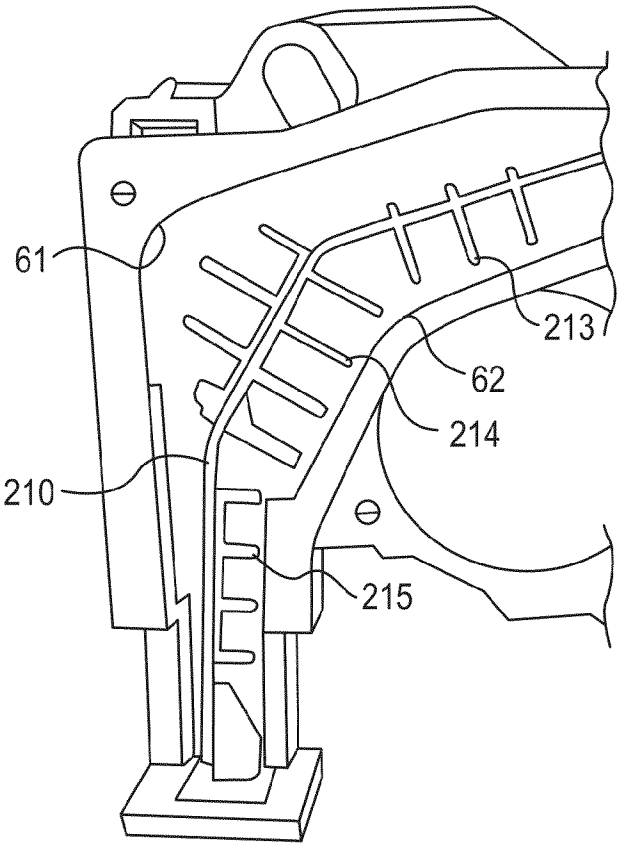
Figure 6E:
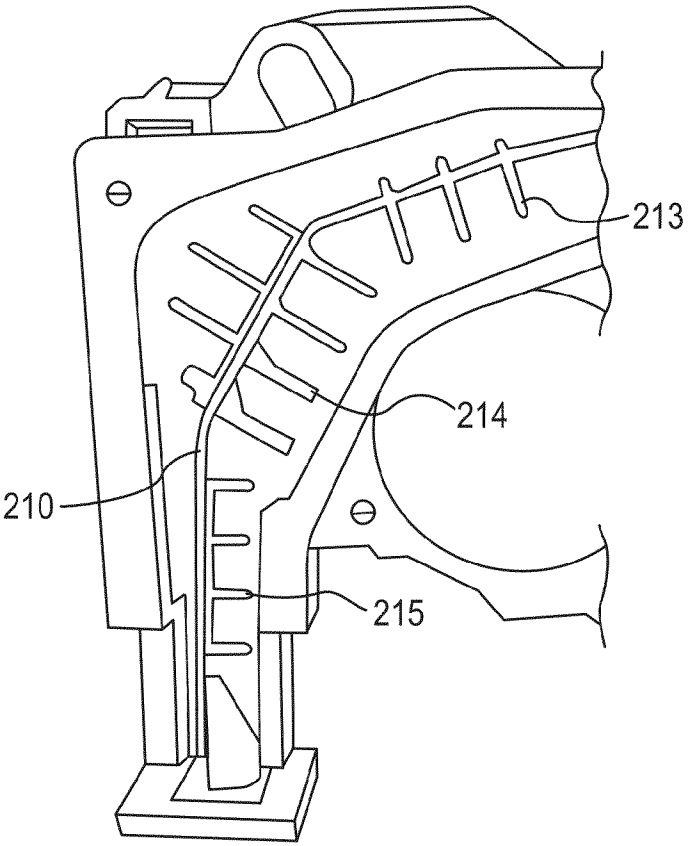

In use, the initial position of agitator 200 at the beginning of a toner reclaim cycle and crankshaft 25 at a 0° mark is shown in FIG. 6A. In this position fins 213, 214 and 215 of blade 210 are poised to scrape toner from lower wall 62 of housing 60. In FIG. 6B crankshaft 25 has rotated 80° into a down stroke and all of the fins have come off lower wall 62 to let toner fall through. Crankshaft 25 has rotated 130° in FIG. 6C and agitator 66 beings to bend on the down stroke of crankshaft 25 forcing top fins 214 to come into contact with upper wall 62. In FIG. 6D crankshaft 25 has rotated 200° and fins 214 are sweeping upper wall 61 while simultaneously not blocking toner from falling through the exit of housing 60. Crankshaft 25 has rotated 280° in FIG. 6E and the sweeping motion along upper wall 61 of blade 210 is nearing full cycle as the fins begin to engage the lower surface 62 of housing 60. In FIG. 6F crankshaft 25 has rotated 360° and fins 213, 214 and 215 have begun contact with lower wall 62 again and in position to scrape toner from it as the cycle is repeated.

In recapitulation, an improved cleaner exit agitator has been disclosed that reduces clogging. The agitator is configured to include a blade with a more flexible spine, longer fins, modified exit and weep holes on a horizontal surface portion to reach more of an exit chute and allow loosened toner to exit more easily. Another improved agitator is disclosed that includes a spring that is intended to impart random mechanical impulses to prevent toner collecting at the exit of the chute.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A customer replaceable unit for use in a printing machine includes a toner reclaim system, said toner reclaim system comprising:

a cleaning blade for removing toner from a photoreceptor;

an auger for moving said toner cleaned from said photoreceptor across a top portion of said customer replaceable unit;

a crankshaft connected to and adapted for rotating said auger; and an agitator positioned within a housing and adapted to receive said toner removed from photoreceptor, said agitator being connected to said crankshaft such that rotation of said crankshaft causes movement in unison of said agitator to thereby loosen and push said toner received within said housing from said auger to an exit portion of said housing, said agitator including a blade with fins on one portion thereof and a spring surrounding another portion thereof.

2. The customer replaceable unit of claim 1, wherein said housing includes upper and lower walls on opposite sides of said agitator.

3. The customer replaceable unit of claim 2, wherein said blade of said agitator includes fingers extending outwardly therefrom that in reach approximates said upper and lower walls of said housing in order to scrape the same.

4. The customer replaceable unit of claim 3, wherein said spring is adapted to present compressed and uncompressed motion to said toner due to rotation of said crankshaft in order to prevent compaction of said toner.

5. The customer replaceable unit of claim 4, wherein said motion generated by said spring moves toner down and out of said housing.

6. The customer replaceable unit of claim 5, wherein said spring has one end thereof secured below said fins on said blade and a remote end thereof resting on said exit portion of said housing.

7. The customer replaceable unit of claim 6, wherein said photoreceptor is a part of said customer replaceable unit.

8. The customer replaceable unit of claim 7, including a charger for charging said photoreceptor as part of said customer replaceable unit.

9. A customer replaceable unit for use in a reprographic device includes a toner reclaim system, said toner reclaim system comprising:

a cleaning blade for removing toner from a photoreceptor;

an auger for moving said toner cleaned from said photoreceptor across a top portion of said customer replaceable unit;

a crankshaft connected to and adapted to rotate said auger; and an agitator positioned within a housing and adapted to receive said toner removed from said photoreceptor, said agitator being connected to said crankshaft such that rotation of said crankshaft causes movement in unison of said agitator to thereby loosen and push said toner received within said housing from said auger to an exit portion of said housing, said agitator including a blade with first, second and third sets of fins extending therefrom, said first, second and third sets of fins including at least three fins each.

10. The customer replaceable unit of claim 9, wherein at least a majority of said first, second and third sets of fins have beveled ends to facilitate scrapping of toner from upper and lower surfaces of said housing, and wherein said first, second and third sets of fins are positioned in a single line with respect to each other.

11. The customer replaceable unit of claim 10, wherein said second set of fins are extended beyond said first and third set of fins.

12. The customer replaceable unit of claim 11, wherein said blade includes section joints connecting said second set of fins to said first and third sets of fins positioned on opposite sides thereof, said blade having less material in said section joints than throughout in order to enhance flexibility in said agitator.

13. The customer replaceable unit of claim 12, wherein said blade includes holes in a portion thereof to prevent toner from clumping as it is pushed towards said exit of said housing.

14. The customer replaceable unit of claim 13, wherein said blade includes a tail fin at a lower end thereof configured to push toner while simultaneously creating a high bending torque on said blade during rotation of said crankshaft in order to allow said first, second and third sets of fins to conform to said upper and lower surfaces of said housing.

15. The customer replaceable unit of claim 14, wherein said blade includes a flat backside of a portion thereof that supports said tail fin, and wherein said flat backside of said blade enhances clearance of said blade with respect to said exit portion of said housing.

16. The customer replaceable unit of claim 15, wherein said tail fin includes a ramp member that eases up and down movement of said agitator within said exit portion of said housing.

17. A method for reclaiming toner in a customer replaceable unit, comprising:

providing a cleaning blade for removing toner from a photoreceptor;

providing an auger for moving said toner cleaned from said photoreceptor across a top portion of said customer replaceable unit;

providing a crankshaft connected to and adapted to rotate said auger; and providing an agitator positioned within a housing and adapted to receive said toner removed from photoreceptor, said agitator being connected to said crankshaft such that rotation of said crankshaft causes movement in unison of said agitator to thereby loosen and push said toner received within said housing from said auger to an exit portion of said housing, said agitator including a blade with first, second and third sets of fins extending therefrom, said first, second and third sets of fins including at least three fins each.

18. The method of claim 17, including beveling at least a majority of ends of said first, second and third sets of fins in order to facilitate scrapping of toner from surfaces of said housing, and wherein said first, second and third sets of fins are positioned in a single line with respect to each other.

19. The method of claim 18, including extending said second set of fins beyond said first and third set of fins and orthogonally with respect to said blade.

20. The method of claim 17, including providing said blade with section joints connecting said second set of fins to said first and third sets of fins positioned on opposite sides thereof, and providing said blade with less material at said section joints than throughout in order to enhance flexibility in said agitator.

* * * * *